US005316294A

United States Patent [19]

Turangan

[11] Patent Number: 5,316,294

[45] Date of Patent: May 31, 1994

[54] GLOVE AND BALL FACILITATING A GAME OF CATCH

[75] Inventor: Farid J. Turangan, Fremont, Calif.

[73] Assignees: Steven M. Allgeier, Santa Monica; Julius A. Turangan, Fremont, both of Calif.

[21] Appl. No.: 862,797

[22] Filed: Apr. 3, 1992

[51] Int. Cl.[5] ..... A63B 43/02

[52] U.S. Cl. ..... 273/65 EG; 2/159; 2/161.1; 273/412

[58] Field of Search ..... 273/412, 346, DIG. 30, 273/65 EG; 2/159, 161 A, DIG. 6

[56] References Cited

U.S. PATENT DOCUMENTS

| | | | |
|---|---|---|---|
| 2,216,242 | 10/1940 | Kirchner, Jr. et al. | 2/159 |
| 3,032,345 | 5/1962 | Lemelson | 273/346 |
| 3,096,523 | 7/1963 | Bruchas | 2/159 |
| 3,597,765 | 8/1971 | Stanton | 2/159 |
| 3,927,881 | 12/1975 | Lemelson | 273/DIG. 30 X |
| 4,183,100 | 1/1980 | DeMarco | 2/159 |
| 4,244,576 | 1/1981 | Mosier et al. | 273/DIG. 30 X |
| 4,303,247 | 12/1981 | Fain | 273/DIG. 30 X |
| 4,718,677 | 1/1988 | Barnes | 273/DIG. 30 X |
| 4,986,548 | 1/1991 | Conner | 273/346 |
| 5,183,263 | 2/1993 | Kuebler | 273/346 X |

FOREIGN PATENT DOCUMENTS

| | | | |
|---|---|---|---|
| 2807658 | 9/1979 | Fed. Rep. of Germany | 2/161 A |

OTHER PUBLICATIONS

Playthings, Dec. 1986 p. 38 Sticky Fingers.

*Primary Examiner*—Paul E. Shapiro
*Attorney, Agent, or Firm*—Richard L. Myers

[57] ABSTRACT

A game of catch is enhanced by the provision of a special glove and football. The glove is symmetrical so that it can be worn on either the right hand or the left hand and is formed from a close fitting elastic fabric. One part of a hook and loop fastener is attached to the glove while a complimentary part of the hook and loop fastener is attached to the football. The fasteners are disposed on the glove in a preferred pattern which provides a large area of contact without inhibiting the flexibility of the glove. The fasteners are attached to the football in a preferred configuration which completely covers the end sections of the football while leaving the central section of the football with spaced fasteners facilitating the grasping and throwing of the football.

8 Claims, 1 Drawing Sheet

GLOVE AND BALL FACILITATING A GAME OF CATCH

BACKGROUND OF THE INVENTION

1. Field of the Invention

This invention relates generally to apparatus useful in a game of catch and more specifically to a glove and ball provided mutually attractive materials facilitating the game of catch.

2. Discussion of Prior Art

In the past, various mitt and ball combinations have been provided with hook and loop materials which facilitate catching the ball with the mitt. Where the hook and loop material has completely covered the mitt, is has provided the mitt with relatively rigid characteristics which make it difficult for the user to bend his or her hand while catching the ball. Where the hook and loop material has only been disposed in certain areas of the mitt, the mitts have not had a symmetrical configuration permitting use on either the right or left hand of the user. These mitts have not been formed from close fitting, elastic material; as a consequence, they have been less responsive to articulation of the user's hand.

Balls adapted for this game of catch have typically had spherical configurations. Where footballs have been contemplated, the hook and loop material has been provided in widely separated longitudinal strips extending across the central section of the football. Since footballs are thrown with their end sections leading, the absence of velcro over their end sections has made this type of ball particularly difficult to catch with a mitt.

SUMMARY OF THE INVENTION

In accordance with the present invention, a glove is formed from elastic material so that it closely fits the hand of the user. Hook and loop material is provided on both sides of the glove to facilitate catching the ball with both the front and back side of the hand. The glove is provided with a symmetrical configuration so that it can be worn on either the left hand or the right hand of the user.

In one case, the hook and loop material is applied to the major surfaces of the glove in three patches. A first patch covers the fingers and adjacent portions of the palm, the second patch covers the heal of the hand, and the third patch extends along the thumb. This configuration of patches enhances the manufacturability of the glove and promotes the bending of the hand along normal hand creases to facilitate catching the ball.

The football of the present invention includes strips of the hook and loop material which completely cover the end sections of the football. In the central section of the football, the hook and loop material is alternated with the outer surface of the ball around the circumference. This facilitates gripping the football particularly at the raised edges of the strips.

These and other features and advantages of the invention will become more apparent with a description of preferred embodiments and the best mode of the invention, and reference to the associated drawings.

DESCRIPTION OF PREFERRED EMBODIMENTS AND BEST MODE OF THE INVENTION

Figure 2:
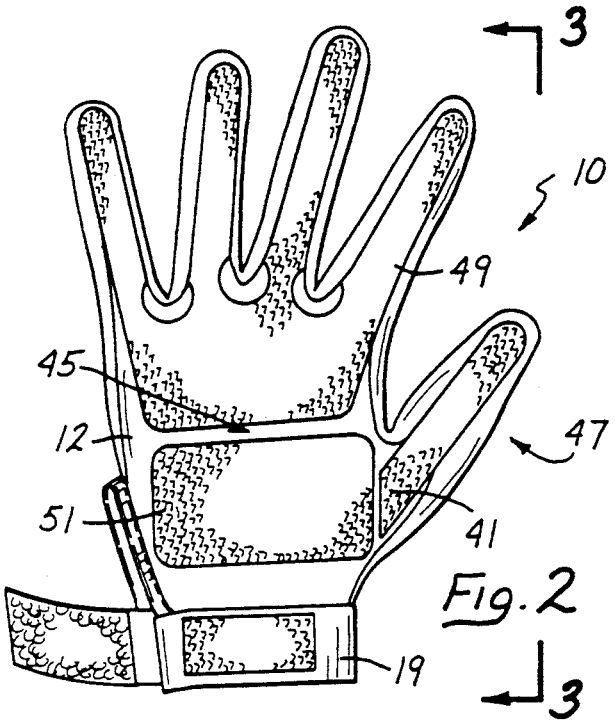
FIG. 2 is a plan view of one side of the glove, the opposite side being generally a mirror image of FIG. 2.
Figure 1:
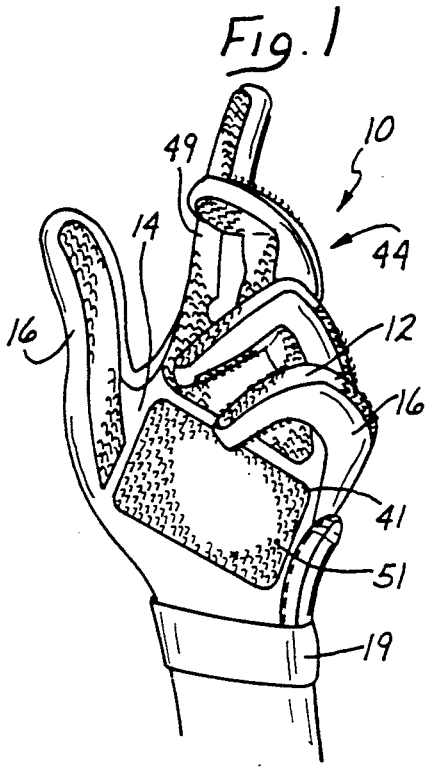
FIG. 1 is a perspective view of a preferred embodiment of a glove associated with the present invention and disposed on the hand of a user.
Figure 3:
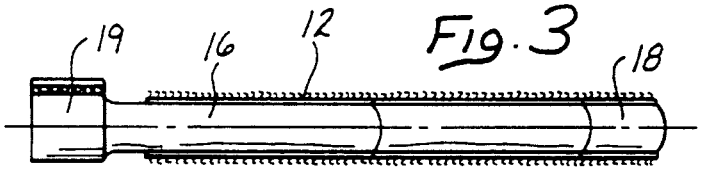
FIG. 3 is a side elevation view of the glove viewed from lines 3—3 of FIG. 2.

A glove is illustrated in FIG. 1 and designated generally by the reference numeral 10. The glove 10 includes a first fabric panel 12 and a second fabric panel 14 which are generally the same size and shape in a preferred embodiment. These panels 12 and 14 are configured to cover alternatively the palm of the hand of the user, or the back of the hand when worn on the right hand and the back of the hand and palm of the hand respectively when worn on the left hand of the user. A gusset panel 16 is provided to connect the first and second panels around the periphery of the glove. This gusset panel 16 increase the comfort of the glove and also facilitates its symmetrical configuration. The gusset panel 16 is disposed generally in a plane 18 which separates the first panel 12 from the second panel 14.

The glove 10 is preferably formed of an elastic fabric material such as provides the glove with a close fit to the hand of the user and facilitates articulation of the fingers and thumb of the hand while catching a ball. A preferred embodiment of the glove 10 includes a wrist band 19.

Also included in the invention is a football having a central section 23 which is disposed between end sections 25 and 27. Each of the end sections 25, 27 has a pointed end 30, 32, respectively. These ends 30, 32 are disposed along an axis 34 of the football.

The central section 23 is progressive enlarged toward a central plane 36 which extends perpendicular to the axis 34 intermediate the ends 30, 32. The football 21 is symmetrical about this central plane 36. The sections 23, 25 and 27 provide the football 21 with an outer surface 38.

The catching of the football 21 by a person wearing the glove 10 is greatly facilitates by the provision of hook and loop fasteners which are alternatively attached to both the glove 10 and the football 21. In a preferred embodiment, hook fasteners 41 are attached to the first and second panels 12, 14 of the glove 10, while loop fasteners 43 are attached to the outer surface 38 of the football 21.

The pattern with which these fasteners 41, 43 are attached to the glove and football 10 and 21, respectively, is of particular interest to this invention. With respect to the glove 10, the hook fasteners 41 are preferably provided on both sides of the glove 10. Thus, hook fasteners 41 are attached to both the first panel and the second panel. This enables a user to catch the football 21 on either side of the hand. It also enables the glove 10 to be used on either the left hand, where the first panel 12 is at the palm of the glove, or on the right hand, where the second panel 14 is at the palm of the glove.

It has been found that the hook fasteners 41 perform best when provided on fingers 44, the palm 45 and a thumb 47 of the glove 10. If the fastener 41 is provided as a single patch of material (not shown), its stiffness may retard the flexibility of the glove 10. For this reason, it may be desirable to provide the hook fasteners 41 in multiple patches which provide separation, for example, across the palm 45 and the thumb 47 of the glove 10. As illustrated in FIG. 1 the hook fasteners 41 are disposed in three patches 49, 51 and 53. The first patch 49 extends along the fingers 44, the second patch 51 is positioned in the palm 45, and the third patch 53 extends along the thumb 47.

It is of particular advantage that the finger patch 49 extends at least partially across the palm 45. This enables the finger patch 49 to accommodate each of the fingers 44 with a single patch 49. This greatly facilitates manufacture of the glove 10.

Although the hook fasteners 41 have been described with reference to the first panel 12, it will be apparent that this same configuration of patches 49, 51 and 53 can be equally applied to the second panel 14 to maintain the symmetry of the glove 10.

The loop fasteners 43 are attached to the outer surface 38 of the football 21. The pattern of this attachment can facilitate not only the catching of the football 21, but also the throwing of the football 21. In a preferred embodiment, the loop fasteners 43 are provided in a plurality of rectangular strips 54 which extend between the ends 30, 32 of the football 21. These strips have a combined width which is less than the largest circumference of the football 21 so they tend to be separated across the central section 23.

Figure 4:
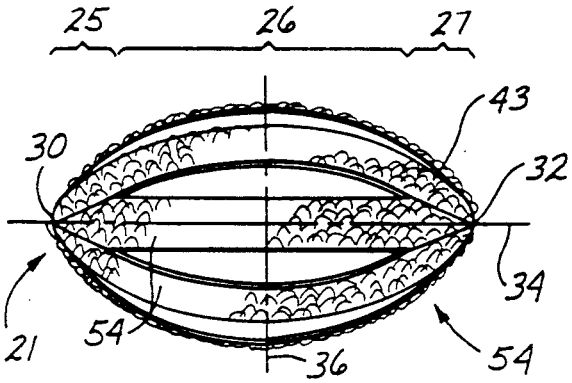
FIG. 4 is a side elevation view of a preferred embodiment of a football associated with the present invention.
Figure 5:
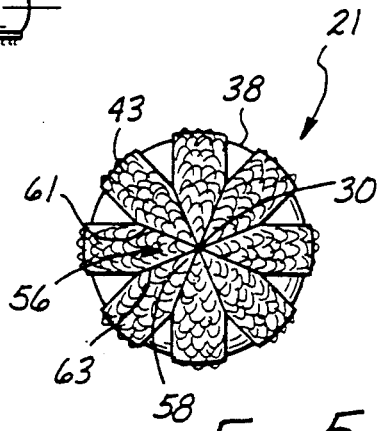
FIG. 5 is an end view of the football illustrated in FIG. 4.

As these strips 54 approach the ends 30 and 32, the space separating the strips 54 begins to decrease until the strips 54 overlap or otherwise form a continuous surface which fully covers the end sections 25 and 27 of the football 21. In a preferred embodiment, the overlapping portions of the strips 54 are cut in a "v" shape best illustrated in FIG. 4. In this case, the strips 54 fully cover the end sections 25 and 27 without overlapping. In a preferred embodiment which includes light strips, each end of the strips 54 is cut at an angle of 45° into the shape of a "V" distinguished by the reference numeral 56. In this embodiment the "V" 56 includes an apex 58 and a pair of side edges 61, 63 which are equal in length. By placing the apex 58 at the end 30 of the football 21, each of the strips 54 can be aligned to fully cover the end section 25, 27 without overlapping.

It is particularly desirable that the strips 54 not fully cover the central section 23. With the illustrated pattern wherein the strips 54 alternate with exposed portions of the outer surface 38, the strips 54 provide raised edges which facilitate grasping the football 21. Since this raised edge 65 occurs on both sides of the strips 54, the football 21 can be grasped with increased facility by either the right or left hand.

In accordance with the present invention, the glove 10 is provided with a close fit and elastic characteristics which permit the hand of a user greater articulation for catching a ball, such as the football 21. By providing the mutually attractive hook and loop fasteners 41, 43, the football 21 can be more easily caught by the glove 10. Placement of the patches 47, 49 and 51 can be important in order to enhance the flexibility and manufacturability of the glove 10. With the provision of the loop fasteners 45 in the form of strips 54, the end sections 25 and 27 of the football 21 can be fully covered by the loop fasteners 43 while maintaining a raised edge 65 along the central section 23 of the football.

It will be apparent that both the glove 10 and the football 21 can be otherwise configured. Any glove, whether it includes the features of an elastic material, preferred placement of fasteners or symmetry of construction can benefit from the concept of this invention. Similarly, any ball can benefit from the placement of loop fasteners in the form of strips which provide fully covered opposite ends and spaced strips along a central section.

Although the invention has been described with reference to specific embodiments, it will now be apparent that several of the features discussed can be varied all within the scope of the invention. For this reason, the scope of the concept should be determined not merely with reference to the drawings and written specification, but rather with reference to the following claims.

What is claimed is:

1. A throw and catch set comprising in combination:

a glove for covering a hand including a first section of the glove configured to cover the palm side of a hand, a second section of the glove to cover the back side of the hand;

the first section of the glove being similar in shape to the second section, with the glove being generally symmetrical about a plane passing between the first section and the second section of the glove;

a plurality of patches of a first material adhered to both the first section and the second section of the glove, the patches including a first patch disposed on the glove to extend along the palm and fingers of the hand and a second patch disposed on the glove to extend across the palm of the hand in a separated relationship to the first patch; and a football having an outer surface, two tapered ends including a leading end which leads the football when the football is thrown, and a central section progressively enlarged between the two ends;

a second material disposed to cover completely the leading end of the football, the second material being in the form of a plurality of strips adhered to the outer surface of the football and alternating with the outer surface around the central section of the football, each strip extending from one end of the football to the other end of the football and having a thickness sufficient to form a raised edge to facilitate gripping the football, wherein the strips are aligned to fully cover the ends of the football without overlapping; and the first and second materials having mating characteristics such that the first material releasably holds the second material to facilitate catching the football with the glove.

2. The throw and catch set recited in claim 1, wherein the first section and the second section of the glove are formed of a fabric having elastic characteristics facilitating a close fit on the hand of the user.

3. The throw and catch set recited in claim 1, wherein each strip includes a pair of generally V-shaped ends, such that each strip end meets an adjacent strip end at an end of the football without overlapping.

4. The throw and catch set recited in claim 1, wherein the glove further comprises an adjustable wrist band for providing a close fit around the wrist of the user.

5. The throw and catch set recited in claim 1, further comprising a third patch extending along the thumb of the hand in a separated relationship to the first and second patches.

6. The throw and catch set recited in claim 5, wherein the first patch extends along substantially the entire length of each finger, and the third patch extends along substantially the entire length of the thumb.

7. A football having an outer surface and being adapted to be caught by a glove or mitt which is at least partially covered by a first material, the football including:

an outer surface;

two tapered ends, one of which leads the football when the ball is thrown;

a central section progressively enlarged between the two ends;

a second material disposed to cover completely the leading end of the ball, the second material being in the form of a plurality of strips adhered to the outer surface of the football and alternating with the outer surface around the central section of the football, each strip extending from one end of the football to the other end of the football and having a thickness sufficient to form a raised edge to facilitate gripping the football, the strips being aligned to fully cover the ends of the football without overlapping; and the second material having characteristics for being releasably held by the first material of the glove or mitt to facilitate catching the football with the glove or mitt.

8. The football recited in claim 7, wherein each strip includes a pair of generally V-shaped ends, such that each strip end meets an adjacent strip end at an end of the football without overlapping.

* * * * *